US012449239B2

(12) United States Patent
Kasendra et al.

(10) Patent No.: US 12,449,239 B2
(45) Date of Patent: Oct. 21, 2025

(54) BALLISTIC BLOCK AND BALLISTIC WALL MADE OF BALLISTIC BLOCKS

(71) Applicants: Krzysztof Kasendra, Cracow (PL); Tomasz Kasendra, Cracow (PL); Jerzy Kusmierczyk, Bielsko Biala (PL); Jacek Pietrzak, Lubliniec (PL)

(72) Inventors: Krzysztof Kasendra, Cracow (PL); Tomasz Kasendra, Cracow (PL); Jerzy Kusmierczyk, Bielsko Biala (PL); Jacek Pietrzak, Lubliniec (PL)

( * ) Notice: Subject to any disclaimer, the term of this patent is extended or adjusted under 35 U.S.C. 154(b) by 813 days.

(21) Appl. No.: 17/627,655

(22) PCT Filed: Jul. 15, 2020

(86) PCT No.: PCT/PL2020/050051
§ 371 (c)(1),
(2) Date: Jan. 15, 2022

(87) PCT Pub. No.: WO2021/010850
PCT Pub. Date: Jan. 21, 2021

(65) Prior Publication Data

US 2022/0276029 A1 Sep. 1, 2022

(30) Foreign Application Priority Data

Jul. 15, 2019 (PL) ..... 430602

(51) Int. Cl.
*F41J 13/00* (2009.01)

(52) U.S. Cl.
CPC ..... *F41J 13/00* (2013.01)

(58) Field of Classification Search
CPC ... F41J 11/02; F41J 13/00; F41J 13/02; E04B 2/00; E04B 2/02; E04B 2/42
USPC ..... 273/404, 408, 410
See application file for complete search history.

(56) References Cited

U.S. PATENT DOCUMENTS 2,610,503 A * 9/1952 Hall ..... E04B 2/42 D25/118
2,902,853 A * 9/1959 Lofstrom ..... E04B 2/18 52/505
4,573,301 A * 3/1986 Wilkinson ..... E04B 2/18 52/375
4,884,382 A * 12/1989 Horobin ..... E04B 2/8641 52/564
5,735,093 A * 4/1998 Grutsch ..... E04B 2/8635 52/565
5,749,196 A * 5/1998 Bangma ..... E04B 2/46 52/561
5,860,262 A * 1/1999 Johnson ..... E04B 1/14 52/294
6,178,714 B1 * 1/2001 Carney, Jr. ..... E04B 1/34315 52/564

(Continued)

FOREIGN PATENT DOCUMENTS

EP 0332273 A1 9/1989
EP 0648902 A1 4/1995

(Continued)

*Primary Examiner* — Joseph B Baldori

(57) ABSTRACT

A ballistic block in the shape of a prism, comprising a front wall (1), a back wall (2), side walls (3, 4) and a through space (5) intended to be filled with ballistic pellets. The object of the invention is also a ballistic wall (12) made of ballistic blocks (13).

18 Claims, 7 Drawing Sheets

(56) References Cited

U.S. PATENT DOCUMENTS

Figure 1:
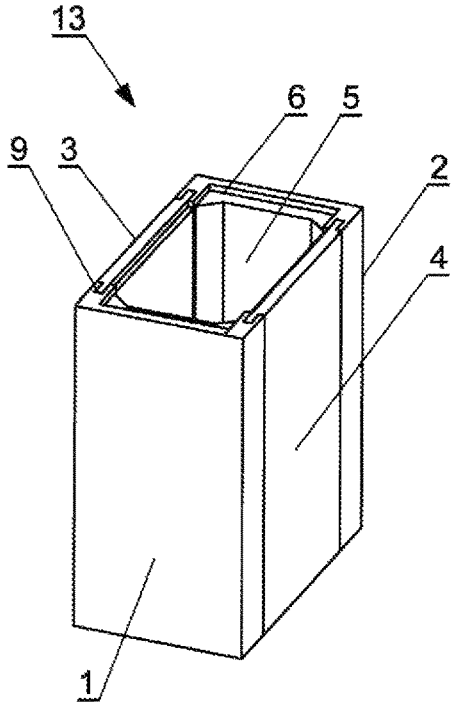

| | | | | |
|---|---|---|---|---|
| 6,212,844 | B1 * | 4/2001 | Lange | E04B 2/702 52/586.1 |
| 6,978,581 | B1 * | 12/2005 | Spakousky | E04B 2/8617 52/424 |
| 7,059,577 | B1 * | 6/2006 | Burgett | E04G 9/10 52/745.1 |
| 7,703,248 | B2 * | 4/2010 | Dincel | E04C 2/34 52/439 |
| 7,845,266 | B2 * | 12/2010 | Duke | F42D 5/045 89/36.01 |
| 9,650,784 | B2 * | 5/2017 | Jensen | E04B 2/18 |
| 9,891,029 | B2 * | 2/2018 | Oh | F41J 13/00 |
| 10,190,855 | B2 * | 1/2019 | Kim | F41J 11/00 |
| 10,473,440 | B1 * | 11/2019 | Ferrelli | B32B 27/32 |
| 10,704,256 | B2 * | 7/2020 | Siver | E04B 2/08 |
| 2008/0148675 | A1 * | 6/2008 | Belsley | E04B 2/40 52/745.1 |
| 2008/0155929 | A1 * | 7/2008 | Herron | E04H 9/04 52/582.1 |
| 2012/0297721 | A1 * | 11/2012 | Rempel | E04B 1/2608 52/655.1 |
| 2013/0298484 | A1 * | 11/2013 | O'Neal | F41H 5/0457 52/272 |
| 2016/0369494 | A1 * | 12/2016 | Sluiter | E04B 5/10 |
| 2017/0175388 | A1 * | 6/2017 | Siver | F41H 5/0414 |

FOREIGN PATENT DOCUMENTS

| | | | |
|---|---|---|---|
| EP | 1057946 | A3 | 12/2000 |
| FR | 3013063 | A1 | 5/2015 |
| GB | 2242730 | A | 10/1991 |
| WO | WO2013087370 | A3 | 6/2013 |

* cited by examiner

BALLISTIC BLOCK AND BALLISTIC WALL MADE OF BALLISTIC BLOCKS

CROSS REFERENCE TO RELATED APPLICATION

This application is national stage entry of PCT/PL2020/050051, filed on Jul. 15, 2020, which in turn claims the priority benefit of Poland Patent Application No. P.430602, filed on Jul. 15, 2019, the content of which are hereby incorporated by reference in its entirety.

The object of the invention is a ballistic block and a ballistic wall made of such blocks.

Known ballistic blocks constitute a uniform block of rubber pellets with glue, vulcanised, glued or pressed in a binding process. Such blocks are made of rubber or the mixtures of rubber, e.g. with polymers. In known solutions of the design of ballistic walls in shooting ranges, it is required to place steel elements, e.g. armoured plates, behind each wall made of solid rubber blocks, and the blocks themselves only constitute an element protecting against the ricocheting of bullets bouncing against plates. When shooting firearms at a new solid ballistic block, bullets form temporary channels and permanent channels inside it, reducing the ballistic properties of the block, therefore causing it to be used up very quickly. After being shot several times through a point, the bullets begin to come out of the solid rubber block and they hit the steel plates. When a bullet hits a steel plate, uncontrollable behaviour of the bullet occurs, including ricocheting of the bullet, bouncing of the bullet, ricocheting of the bullet towards the shooter, endangering the lives or health of humans and the safety of property. This is accompanied by delamination and breakdown of the bullet comprising compounds of lead, zinc and metal oxides, which are deposited in the form of dusts and gases on elements of the equipment of the shooting range, at the same time also being absorbed by the operators and users of the facilities. After a very short time of use, it is required to replace individual elements in their entirety (e.g. ballistic blocks), which entails the disassembly of a part of the ballistic wall and the necessity of its repeated reconstruction. Known blocks are not compatible with anti-ricochet blocks and plates. Parts of bullets captured inside a solid ballistic block prevent its use in the recycling process.

From Polish applications of utility models W.127811 and W.128054 there are known ballistic blocks which require disassembly for refilling the ballistic pellets filling the block. These blocks also require highly precise monitoring of filling with ballistic pellets (the lack of such monitoring causes a complete loss of ballistic properties of the block). The lack of tightness of joints between blocks causes the formation of temporary channels and permanent channels, through which the ballistic pellets may be released outside, which necessitates frequent refilling of the losses of ballistic pellets in the ballistic wall.

The essence of the solution according to the invention is a ballistic block in the shape of a prism comprising a front wall, a back wall, side walls and a through space intended to be filled with ballistic pellets.

Preferably, the upper and lower edges of the front wall, the back wall and the side walls are provided with cuts.

Preferably, the side walls are provided with recesses from the inner side.

Preferably, the front wall, the back wall and the side walls are finger-jointed to each other, preferably with a skew.

Preferably, the front wall, the back wall and the side walls are connected to each other by gluing, preferably by means of polyurethane glue.

Preferably, the front, back and side walls are connected to each other by means of mounting pins.

Preferably, the ballistic block constitutes a monolith lacking joints between the front, back and side walls.

Preferably, the ballistic block is provided with at least one partition wall.

Preferably, the partition wall is provided with through holes.

The essence of the solution according to the invention is also a ballistic wall made of ballistic blocks, comprising at least two layers of ballistic blocks arranged horizontally, situated one on top of the other.

Preferably, the individual horizontal layers of ballistic blocks (13) are shifted with respect to each other.

Preferably, the ballistic wall is made of two rows of ballistic blocks shifted with respect to each other, so that the joints of individual ballistic blocks would not overlap each other.

Preferably, the ballistic wall is provided with inspection plates with viewing holes.

Preferably, the ballistic wall is provided with stabilising plates placed under the first layer of blocks.

Preferably, the ballistic wall is provided with a stop plate placed behind the first row of ballistic blocks.

Figure 2:
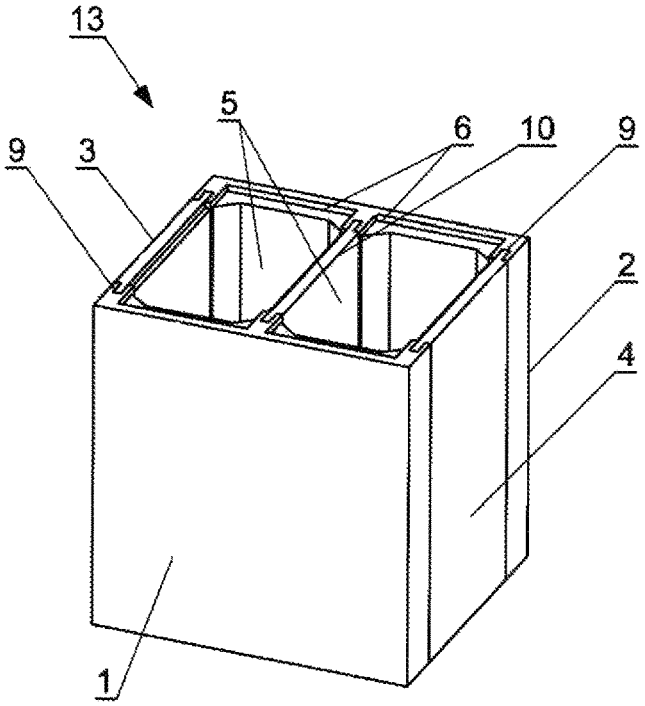
Figure 3:
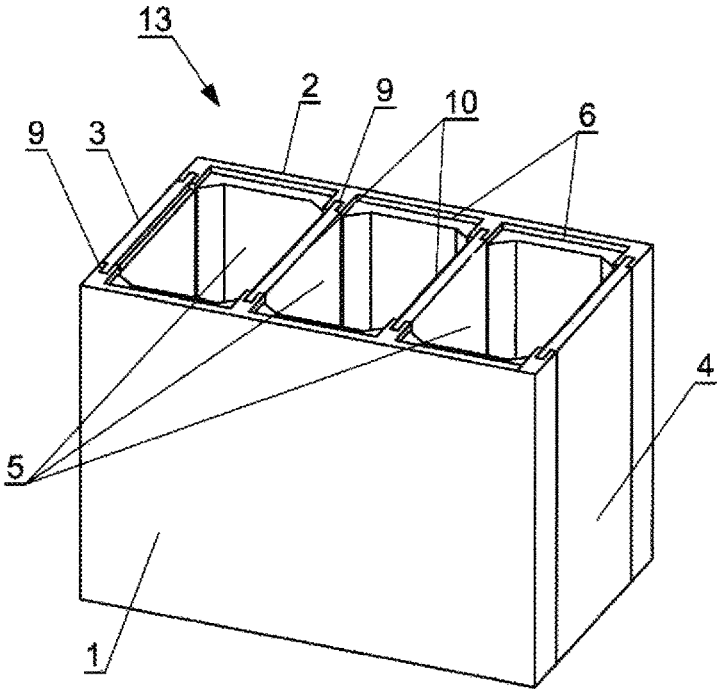
Figure 4:
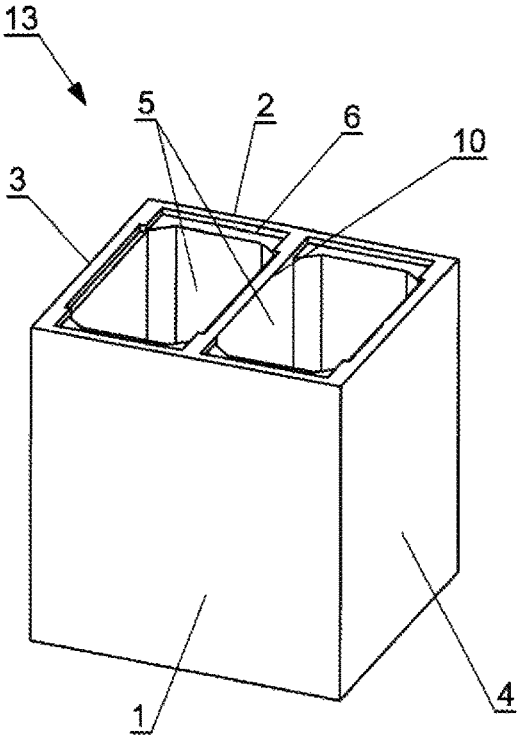
Figure 5:
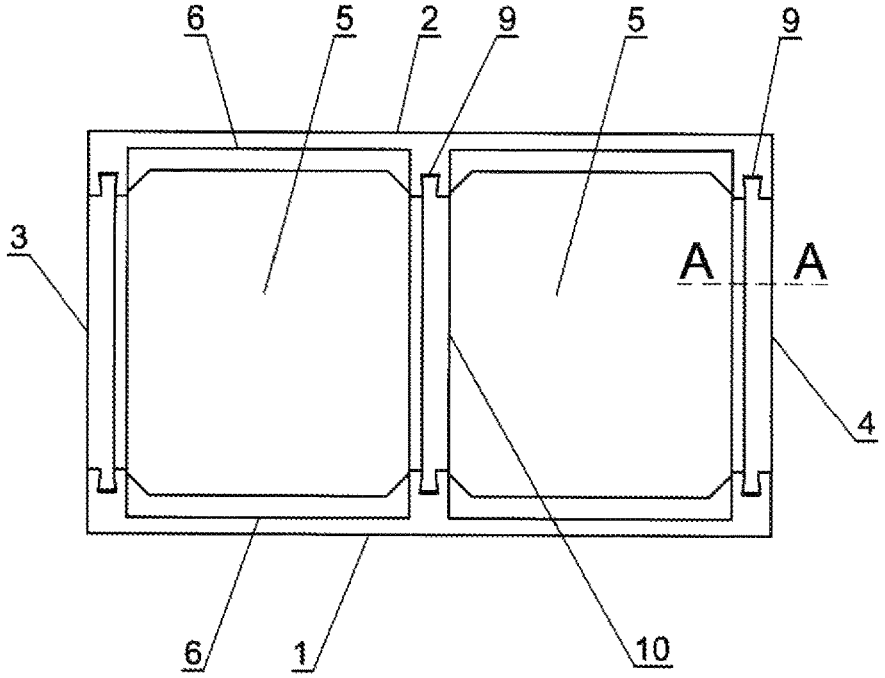
Figure 6:
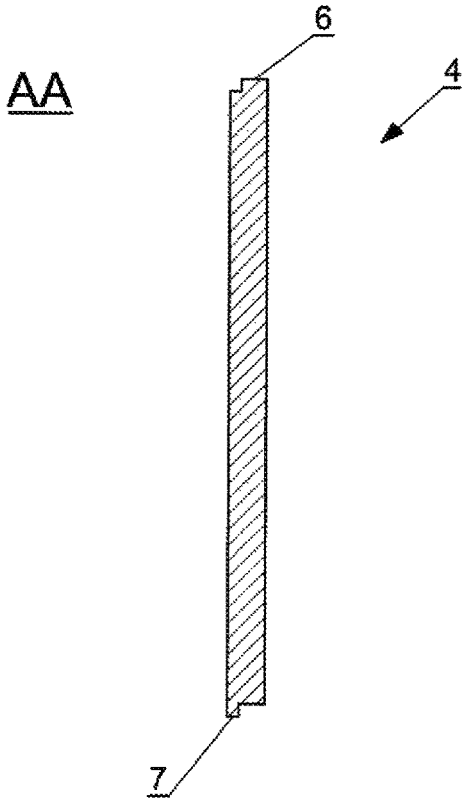
Figure 7:
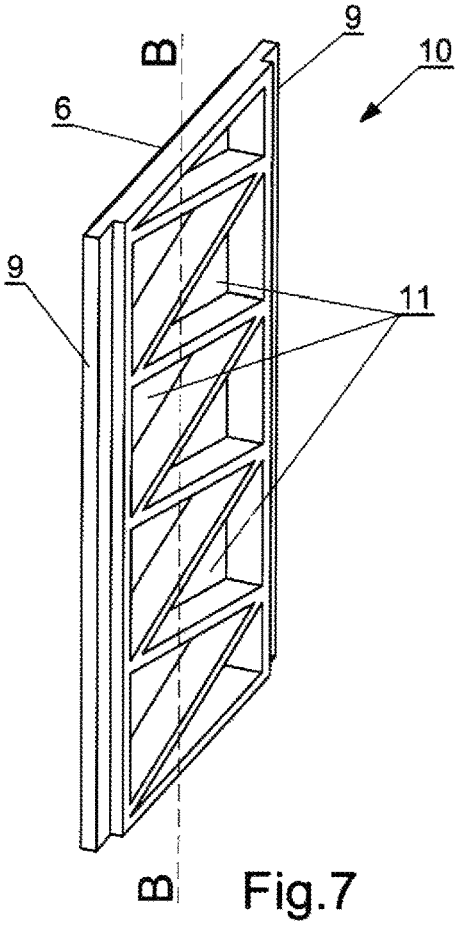
Figure 8:
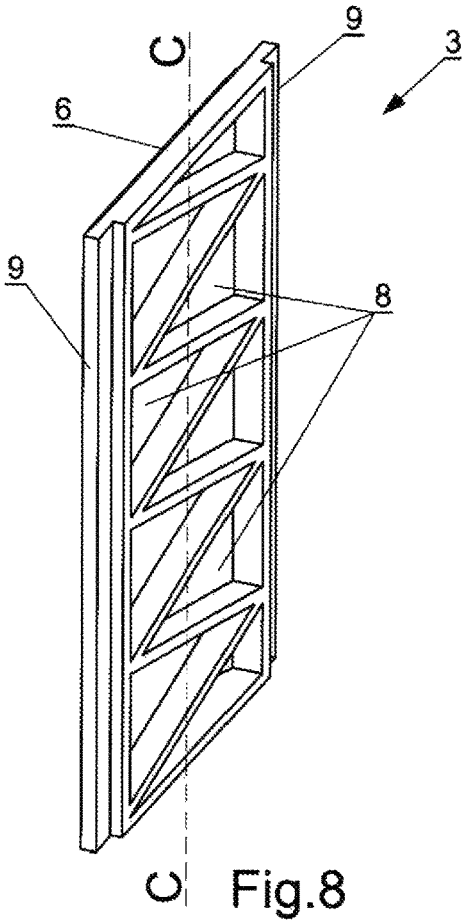
Figure 9:
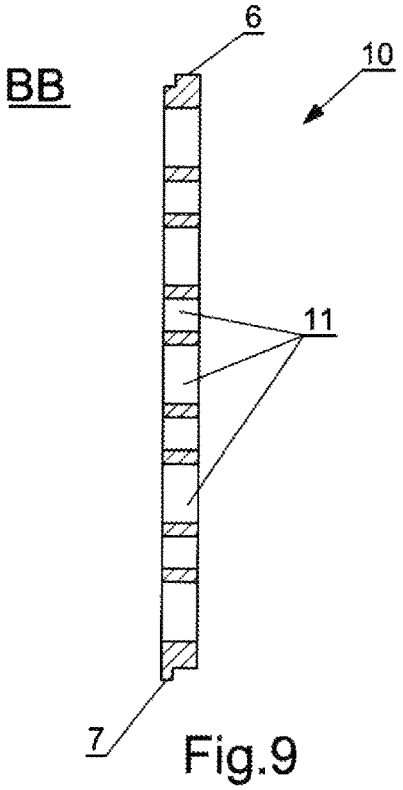
Figure 10:
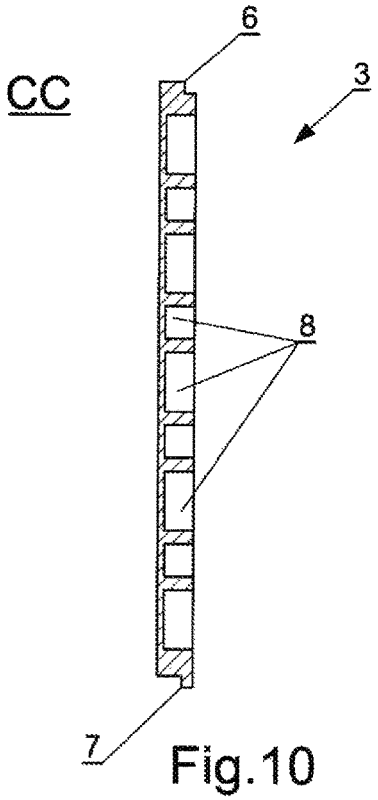
Figure 11:
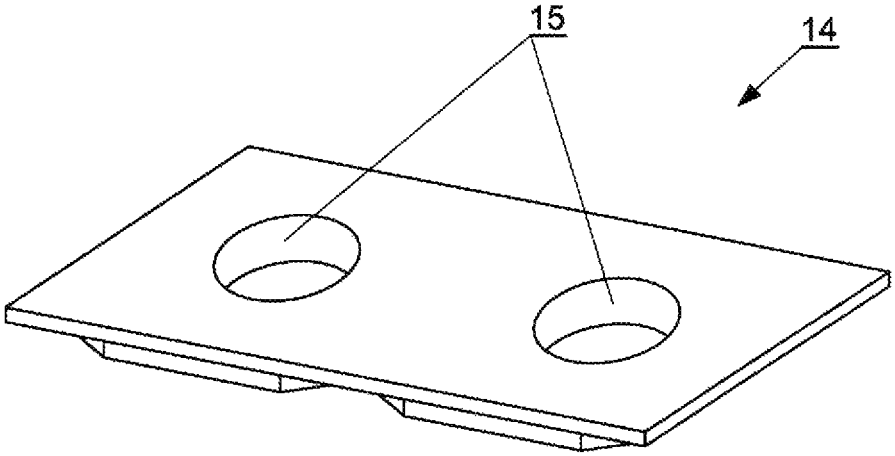
Figure 12:
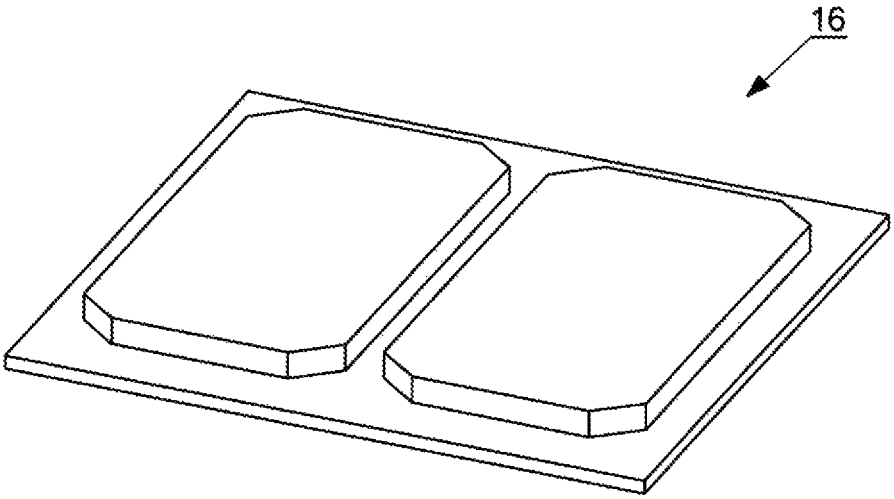
Figure 13:
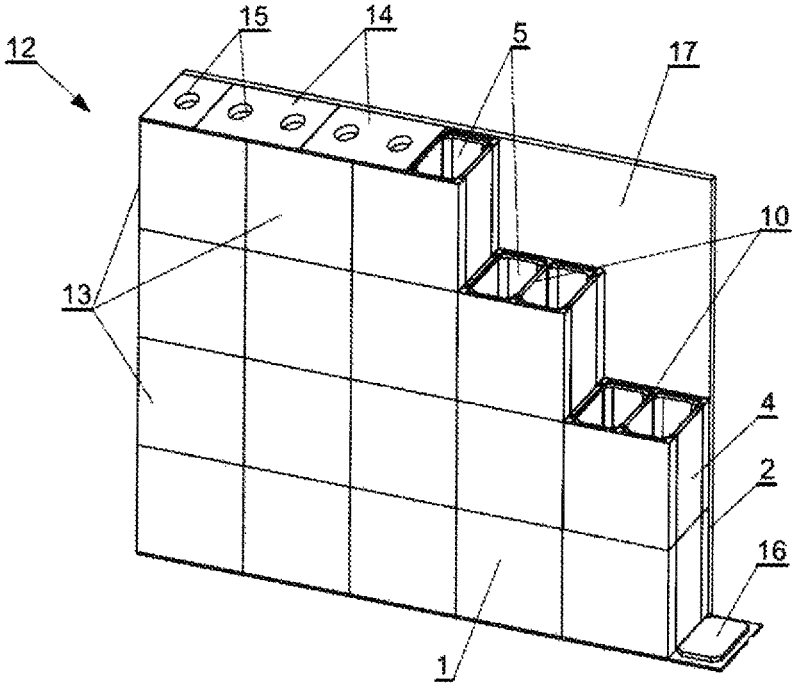
Figure 14:
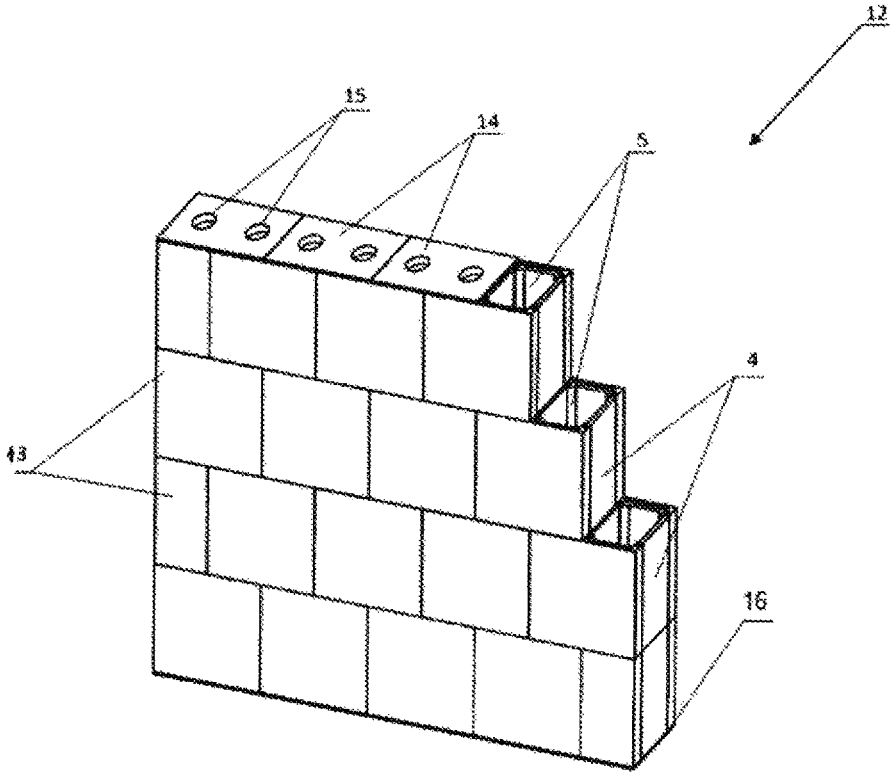
Figure 15:
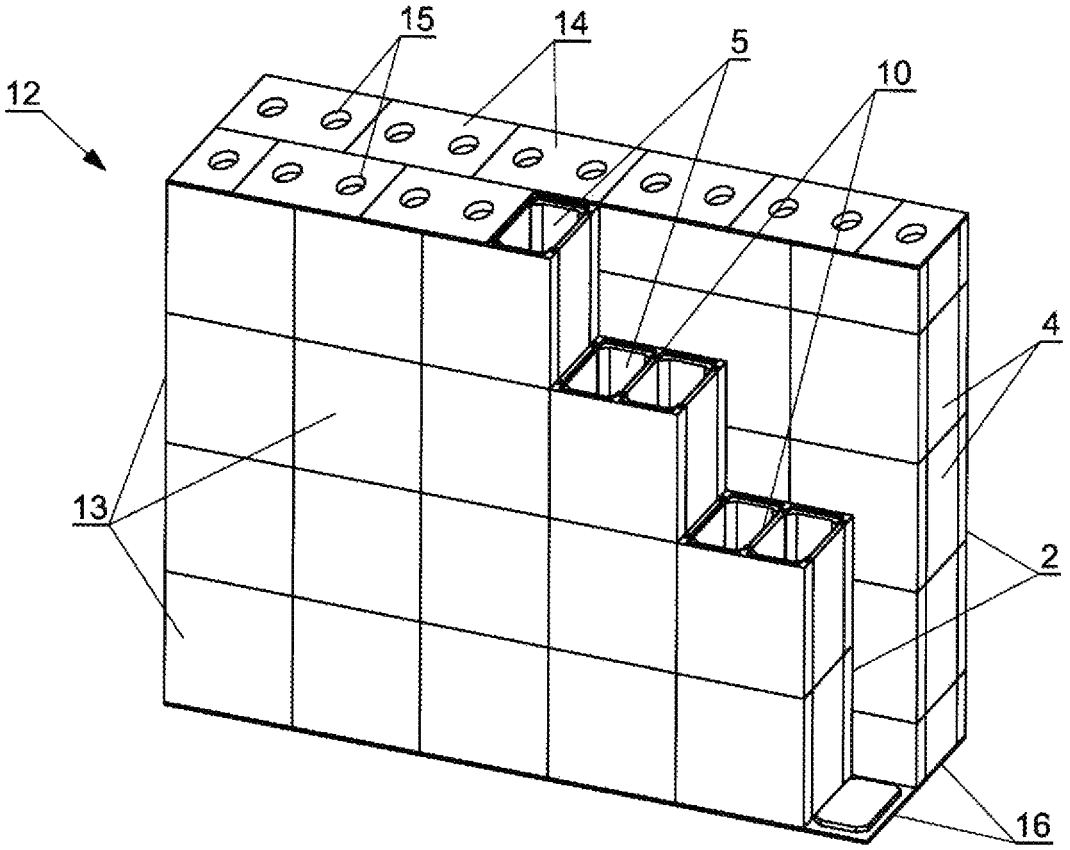

The solutions according to the invention are presented in the attached drawings, where:

FIG. 1 presents the ballistic block 13 in a perspective view;

FIG. 2 presents the ballistic block in a perspective view, provided with one partition wall 10;

FIG. 3 presents the ballistic block 13 in a perspective view, provided with two partition walls 10;

FIG. 4 presents the ballistic block 13 in a perspective view, provided with one partition wall 10, made of a single block, and therefore lacking joints between the walls 1, 2, 3, 4;

FIG. 5 presents the ballistic block 13 in a general top view, provided with one partition wall 10;

FIG. 6 presents the side wall 4 of the ballistic block 13 in a cross-section along the line A-A of FIG. 5;

FIG. 7 presents the partition wall 10 of the ballistic block 13 in a perspective side view, provided with through holes 11;

FIG. 8 presents the side wall 3 of the ballistic block 13 in an embodiment provided with recesses 8 situated on the inner side;

FIG. 9 presents a cross-section through the partition wall 10 of the ballistic block 13 along the line B-B of FIG. 7;

FIG. 10 presents a cross-section through the side wall 3 of the ballistic block 13 along the line C-C of FIG. 8;

FIG. 11 presents an inspection plate 14 in a general top view, with visible viewing holes 15;

FIG. 12 presents a lower stabilising plate 16 in a general top view;

FIG. 13 presents a ballistic wall 12 in an axonometric view, made as adjacent columns provided with a stop plate 17;

FIG. 14 presents the ballistic wall 12 in an axonometric view, made with an offset;

FIG. 15 presents the ballistic wall 12 in an axonometric view, made of two rows of ballistic blocks 13.

The ballistic block 13 according to the invention as in the embodiments is presented in the attached drawings. The ballistic block 13 according to the invention has the shape of a prism comprising a front wall 1, a back wall 2 and side walls 3, 4, as well as a through space 5 intended to be filled with ballistic pellets. The upper and lower edges of the front wall 1, the back wall 2 and the side walls 3, 4, are provided with cuts 6, 7, which enables stable connection of overlapping horizontal layers of ballistic blocks 13. The side walls 3, 4 can be in turn provided from their inner or outer side with recesses 8, which prevent them from being torn by flying bullets. Providing the side walls 3, 4 with recesses from both the inner and the outer side results in the joints of the side walls 3, 4 with the side walls of the neighbouring ballistic blocks 13 not being perpendicular to the surface of the front wall 1, which prevents them from being torn. In such an embodiment, the joints of the side walls 3, 4 with the side walls 3, 4 of the neighbouring ballistic blocks take on the shape of a polygonal chain, e.g. resembling a bellows or an undulating line. On the other hand, because of the existence of through spaces 5, after the assembly of ballistic blocks 13 into a ballistic wall 12, gravity columns are formed, intended for placing ballistic pellets (not shown) inside them. The walls 1, 2, 3, 4 of the ballistic block may be finger-jointed to each other 9, preferably with a skew, as well as by means of mounting pins or—additionally or exclusively—by gluing, preferably using polyurethane glue. In another variant (as presented in FIG. 4), the ballistic block 13 according to the invention may be made of a single solid and constitute a monolith lacking joints between the walls 1, 2, 3, 4. In order to reinforce the structure of the block 13, and therefore stability of the ballistic wall 12, the block 13 may have one or more additional partition walls 10. The partition wall 10 can be made of a homogeneous piece of material; it can also comprise through holes 11 allowing partial movement of ballistic pellets. Similar through holes can also be included in the side walls 3, 4. The ballistic block 13 according to the invention may be made of mixtures of polymer plastics with a binder.

The ballistic blocks 13 according to the invention are used to build ballistic walls 12. The ballistic wall 12 according to the invention, as in the embodiments presented in the attached drawings, is made of ballistic blocks 13 according to the invention and it comprises at least two layers of these blocks 13 situated horizontally one on top of the other. The ballistic blocks 13 may have the shape of flat columns adjacent to each other, and in another embodiment (as presented in FIG. 14), the individual horizontal layers of ballistic blocks 13 may be shifted with respect to each other, forming a wall 12 constructed with an offset. In order to provide a room made of ballistic walls 12, certain ballistic blocks 13, placed in the corners of such a room, are positioned perpendicularly to each other. The ballistic wall 12 according to the invention can be provided from the top with an inspection plate 14 with viewing holes 15 used to inspect the state of filling the through spaces 5 and to refill the ballistic pellets. In addition, the back surface of the ballistic wall 12 may be provided with additional protection in the form of a stop plate 17. In turn, in the case of a ballistic wall 12 made of two rows of ballistic blocks 13 (as presented in FIG. 15), the use of a stop plate 17 is not necessary. In such a case, it is important for ballistic blocks 13 arranged in individual rows to be shifted with respect to each other, so that the joints of the blocks would not overlap each other. The double-rowed assembly of ballistic blocks 13 enables the elimination of concrete elements, masonry, plankings and steel plates, including armoured plates, from the structure of walls (bullet traps, shooting ranges, training facilities for close distance combat).

The highest layer of ballistic blocks 13 forming the upper surface of the ballistic wall 12 may be covered by the inspection plate 14 provided with viewing holes 15 used to refill the ballistic pellets. From its bottom, the ballistic wall 12 may be in turn placed on stabilising plates 16, which, similar to the inspection plates 14, reinforce its structure.

The ballistic block 13 according to the invention constitutes a useful solution for the construction of barriers stopping bullets shot from firearms, including the construction of bullet traps in open shooting ranges and in rooms intended for shooting firearms. A basic module for the construction of the ballistic wall 12, serving the function of such a barrier, constitutes a column made of ballistic blocks 13 according to the invention, seated one on top of the other. The inner through spaces 5 of the ballistic blocks form gravity channels allowing free movement of ballistic pellets in the block 13. In this manner, losses of ballistic pellets are refilled automatically (after the formation of a temporary channel by a bullet). Once the bullet has passed through, these channels are automatically refilled with ballistic pellets, moving freely due to gravity; therefore, the structure of ballistic pellets capable of capturing further bullets is restored and refilled by itself. In addition, when stopping among the pellets, the bullet compacts (compresses) the pellets along the direction of its movement, therefore increasing the density of ballistic pellets, which improves the ability of the pellets to capture the bullet (improves ballistic properties). The partition wall 10, preferably placed in the ballistic block 13, reinforces structurally and stabilises the block 13, and therefore the entire structure, with no need for reinforcing it with additional elements. The replacement of used up ballistic blocks 13 according to the invention is simple and quick, even if the replacement involves a block 13 located the lowest in the structure of the ballistic wall 12. The refilling of ballistic pellets does not require monitoring the amount of material inside each ballistic block 13, since any losses are being refilled by themselves via the collection of pellets placed at the top of the structure. Service refilling of the pellets involves pouring the pellets through the viewing holes 15 placed at the top of the ballistic wall 12.

The universal structure of the ballistic blocks 13 enables them to be verticalised, joined as adjacent columns, and to be mounted with a shift, a so-called offset. The ballistic blocks 13 can also be arranged with a shift and perpendicularly, in which manner corners of the structure are formed. The modular design of the ballistic block 13 according to the invention enables the formation of complete walls 12 or rooms without the risk of generating empty spaces and through spots for bullets. Due to the design of the block 13 according to the invention, the gravity channels remain unobstructed regardless of whether the assembly of the blocks 13 takes place as adjacent columns or with an offset. Due to this, after filling the blocks 13 with the ballistic pellets, they always fill the through spaces 5 of the ballistic blocks 13, ensuring full and proper functionality in spite of multiple hits from firearms.

The design of the ballistic block 13 according to the invention causes one side of the block 13 to serve a capturing ballistic function, with a protective ballistic function for the other one. In the case of one side being used up, the block 13 can be reused by rotating by 180 degrees and using it as a capturing ballistic wall. The ballistic blocks 13 according to the invention withstand a much larger number of hits compared to solutions known so far. It is particularly preferable to use them for capturing bullets shot from centrefire firearms, in particular of the 9 mm, 5.56 mm, 7.62 mm, 0.223 REM, 0.308, 0.338 calibres, as well as rimfire and smoothbore firearms.

What is claimed is:

1. A ballistic block, comprising:

a front wall;

a back wall; and side walls each including recesses or through holes at an inner or outer side thereof and along a height thereof from a top to a bottom of each side wall, the side walls connected to the front wall and the back wall, forming a shape of a prism with a through space, wherein the through space is configured to be filled with ballistic pellets, wherein the recesses or through holes of the side walls each have a triangular cross-section, the recesses or through holes of the side walls are each defined by an undulating line extending from the top to the bottom of each side wall, and the undulating line includes a plurality of segments each being non-perpendicular to the front wall, preventing each side wall from being torn apart by a bullet which contacts a respective segment of the plurality of segments of the undulating line that defines the recesses or through holes of each side wall.

2. The ballistic block according to claim 1, wherein each upper and lower edge of each one of the front wall, the back wall, and the side walls is provided with a cutout, wherein, as assembled, each cutout of the front wall, the back wall, and the side walls is configured to provide a stable connection of overlapping horizontal layers of the front wall, the back wall, and the side walls of a plurality of ballistic blocks vertically stacked upon one another.

3. The ballistic block according to claim 1, wherein the front wall, the back wall and the side walls are finger-jointed to each other, with a skew.

4. The ballistic block according to claim 1, wherein the front wall, the back wall and the side walls are connected to each other by a polyurethane glue.

5. The ballistic block according to claim 1, wherein the front wall, the back wall and the side walls are connected to each other by mounting pins.

6. The ballistic block according to claim 1, further comprising monolith lacking joints between the front wall, the back wall and the side walls.

7. The ballistic block according to claim 1, further comprising at least one partition wall connected to the front wall and the rear wall.

8. The ballistic block according to claim 7, wherein the at least one partition wall is provided with through holes.

9. The ballistic block according to claim 8, wherein the through holes of the at least one partition wall are each configured to allow the ballistic pellets to pass therethrough such that the ballistic pellets automatically move to fill a channel formed by a bullet which passed through the ballistic block.

10. The ballistic block according to claim 1, wherein the through space defines a gravity channel such that the ballistic pellets are configured to move freely within the through space to fill a channel formed by a bullet which passed through the ballistic block.

11. A ballistic wall, comprising:

a plurality of ballistic blocks forming at least two layers of ballistic blocks arranged horizontally and situated vertically one on top of the other, each ballistic block of the plurality of ballistic blocks comprising:

a front wall;

a back wall; and side walls each including recesses or through holes at an inner or outer side thereof and along a height thereof from a top to a bottom of each side wall, the side walls connected to the front wall and the back wall, forming a shape of a prism with a through space, wherein the through space is configured to be filled with ballistic pellets, wherein the recesses or through holes of the side walls each have a triangular cross-section, the recesses or through holes of the side walls are each defined by an undulating line extending from the top to the bottom of each side wall, and the undulating line includes a plurality of segments each being non-perpendicular to the front wall, preventing each side wall from being torn apart by a bullet which contacts a respective segment of the plurality of segments of the undulating line that defines the recesses or through holes of each side wall.

12. The ballistic wall according to claim 11, wherein the at least two layers of ballistic blocks are shifted with respect to each other.

13. The ballistic wall according to claim 12, wherein the through space of each ballistic block of the plurality of ballistic blocks defines a gravity channel such that the ballistic pellets are configured to move freely within the through space to fill a channel formed by a bullet which passed through the ballistic block.

14. The ballistic wall according to claim 13, wherein the gravity channel defined by the through space of each ballistic block is unobstructed, allowing the ballistic pellets to move freely between the at least two layers of ballistic blocks which are shifted with respect to each other.

15. The ballistic wall according to claim 11, wherein the ballistic wall comprises two rows of ballistic blocks shifted with respect to each other.

16. The ballistic wall according to claim 11, further comprising:

a top row of ballistic blocks of the plurality of ballistic blocks; and a plurality of inspection plates each being respectively connected to each ballistic block of the top row, wherein each inspection plate of the plurality of inspection plates comprises viewing holes extending therethrough such that the ballistic pellets, within the through space of each ballistic block of the top row, are visible and refillable through the viewing holes.

17. The ballistic wall according to claim 11, further comprising:

a bottom row of ballistic blocks of the plurality of ballistic blocks; and a plurality of stabilizing plates each being respectively connected to each ballistic block of the bottom row.

18. The ballistic wall according to claim 11, further comprising a stop plate connected to a rear of the at least two layers of ballistic blocks, wherein the stop plate is configured to stop a bullet which passed through a respective ballistic block of the plurality of ballistic blocks.

* * * * *